US010597253B2

(12) United States Patent
Wilcoxon et al.

(10) Patent No.: US 10,597,253 B2
(45) Date of Patent: Mar. 24, 2020

(54) AUTOMATED AISLE RUNNER

(71) Applicants: Janice Voncille Wilcoxon, Pleasant Prairie, WI (US); Gerald Wilcoxon, Pleasant Prairie, WI (US); Ben Veal, Lindenhurst, IL (US)

(72) Inventors: Janice Voncille Wilcoxon, Pleasant Prairie, WI (US); Gerald Wilcoxon, Pleasant Prairie, WI (US); Ben Veal, Lindenhurst, IL (US)

( * ) Notice: Subject to any disclaimer, the term of this patent is extended or adjusted under 35 U.S.C. 154(b) by 5 days.

(21) Appl. No.: 16/046,729

(22) Filed: Jul. 26, 2018

(65) Prior Publication Data

US 2018/0370756 A1 Dec. 27, 2018

Related U.S. Application Data

(63) Continuation-in-part of application No. 15/222,834, filed on Jul. 28, 2016, now Pat. No. 10,053,329.

(60) Provisional application No. 62/197,697, filed on Jul. 28, 2015.

(51) Int. Cl.
*B65H 75/44* (2006.01)

(52) U.S. Cl.
CPC ..... *B65H 75/4402* (2013.01); *B65H 75/4471* (2013.01); *B65H 75/4486* (2013.01); *B65H 2701/37* (2013.01)

(58) Field of Classification Search
CPC ..... B65H 75/4402; B65H 75/4471; B65H 75/4486; B65H 75/44; B65H 2701/37
See application file for complete search history.

(56) References Cited

U.S. PATENT DOCUMENTS 1,719,055 A * 7/1929 Herzer ..... B60J 11/02 135/88.13
4,991,789 A * 2/1991 Buerger ..... A47G 27/0287 242/390.8
5,669,574 A * 9/1997 Calhoun ..... A47G 27/0206 242/395
7,597,381 B2 * 10/2009 Hespeler ..... B60P 3/36 296/156
7,677,624 B1 * 3/2010 Koski ..... B60J 7/085 296/1.07
2017/0029240 A1 * 2/2017 Wilcoxon ..... B65H 75/4402

* cited by examiner

*Primary Examiner* — Sang K Kim

(57) ABSTRACT

An automated aisle runner includes an automated control unit, an aisle runner, and a mobile runner extender. The automated control unit includes a housing and a runner roller, wherein the runner roller is rotatably mounted within the housing. The aisle runner is disposed around the runner roller, such that the aisle runner is wound around and unwound from the runner roller as the runner roller is rotated by a motor. The mobile runner extender is provided to ensure the aisle runner is extended in a straight, smooth manner, eliminating problematic tangling. A plurality of lights may be positioned along the aisle runner and a projector integrated into the automated control unit to provide enhanced visual effects, while a speaker provides audial effects. A microcontroller allows a user to control the color and pattern of the plurality of lights, projections, and the audio files played through the speaker.

21 Claims, 25 Drawing Sheets

AUTOMATED AISLE RUNNER

The current application is a continuation in part of the U.S. Utility patent application Ser. No. 15/222,834 filed on Jul. 28, 2016 which claims a priority to the U.S. Provisional Patent application Ser. No. 62/197,697 filed on Jul. 28, 2015.

FIELD OF THE INVENTION

The present invention relates generally to aisle runners. More specifically, the present invention provides an automated control unit for dispensing and retracting an aisle runner.

BACKGROUND OF THE INVENTION

Aisle runners are utilized to provide a decorative walkway at events such as weddings, red carpet events, proms, church affairs, business affairs, school affairs, and community events. While aisle runners visually enhance the environment in which they are placed, the installation of the aisle runners can often be quite difficult. Ensuring that the aisle runner is laid down in a straight, flat manner can often be a daunting task, especially if the material of the aisle runner is heavy. Rarely is the placement of an aisle runner a smooth transition. Often times the aisle runner becomes twisted and tangled, becoming a distraction. An ill placed aisle runner can be visually displeasing and in turn provide the opposite effect intended. Furthermore, the typical aisle runner is difficult to roll up and store when it is no longer needed. It is particularly difficult to ensure that the aisle runner rolls up in a perfect cylindrical fashion, which in turn makes it more difficult to properly align the aisle runner the next time it is used.

Therefore it is an object of the present invention to provide an automated aisle runner that allows an aisle runner to be automatically extended from or retracted into an automated control unit. The present invention ensures that the aisle runner is placed down in a straight, smooth manner. The aisle runner has a runner body that is disposed about a runner roller rotatably mounted within a housing. In some embodiments, a mobile runner extender is provided to deploy the aisle runner from the automated control unit, while a motor is used to retract the aisle runner into the automated control unit. The mobile runner extender may be a manned or unmanned vehicle. In some embodiments, the motor can be actuated in both directions in order to spin the runner roller and in turn extend or retract the aisle runner. In some embodiments, a guide assembly is provided to assist in the extension and retraction of the aisle runner, ensuring the aisle runner is properly placed and properly stored. Furthermore, in some embodiments the present invention may include a plurality of lights and a speaker that provide enhanced visual and audial effects respectively. The plurality of lights and the speaker are controlled by a microcontroller, wherein a user can determine the color and pattern of the plurality of lights and the audio files that are played through the speaker.

DETAIL DESCRIPTIONS OF THE INVENTION

All illustrations of the drawings are for the purpose of describing selected versions of the present invention and are not intended to limit the scope of the present invention.

The present invention is an automated aisle runner that alleviates the difficulties in lying down a typical aisle runner. Furthermore, the present invention provides additional visual and audial effects to the traditional aisle runner. In reference to FIG. 1, the automated aisle runner comprises an aisle runner 1, an automated control unit 2, and a mobile runner extender 8, wherein the automated control unit 2 stores the aisle runner 1 and the mobile runner extender 8 dispenses the aisle runner 1.

Figure 13:
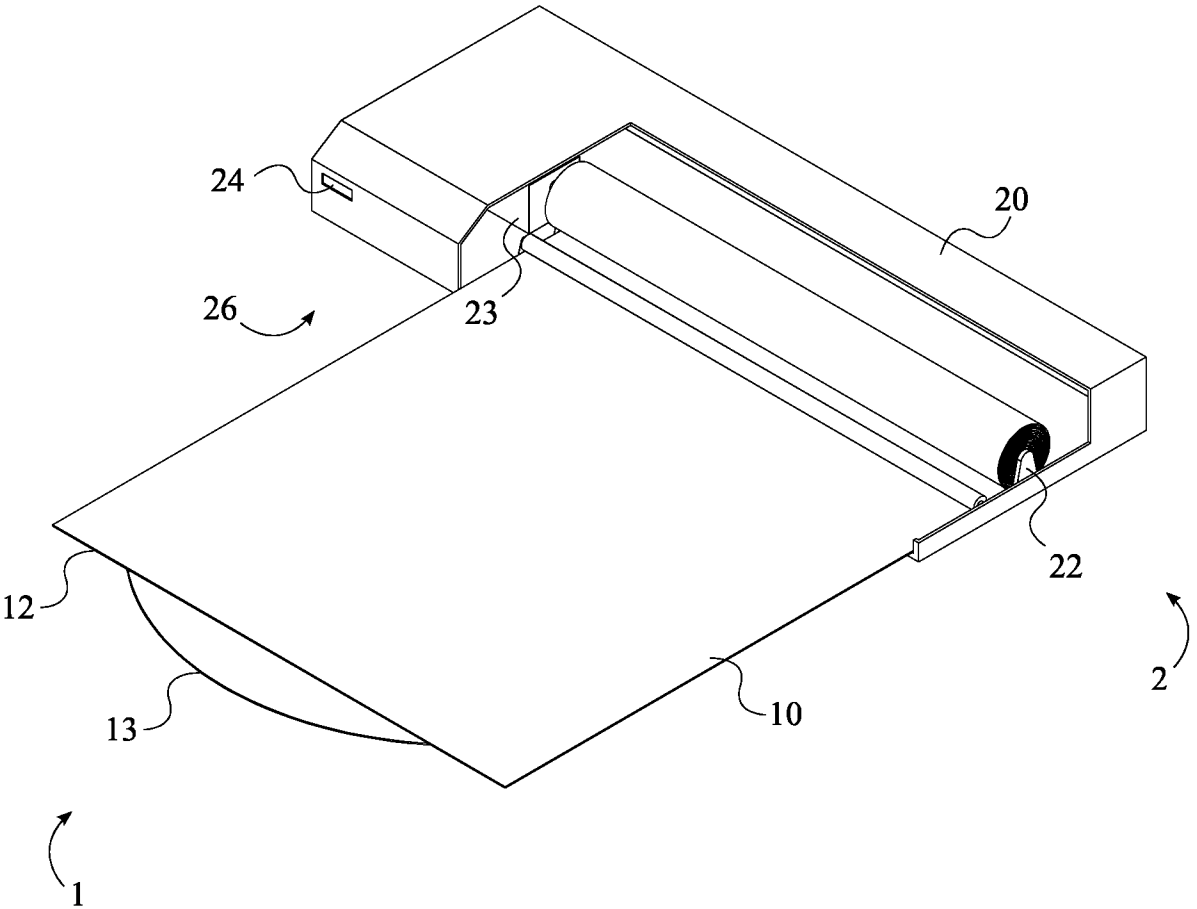
FIG. 13 is a sectional view depicting the runner body being disposed about the runner roller.
Figure 14:
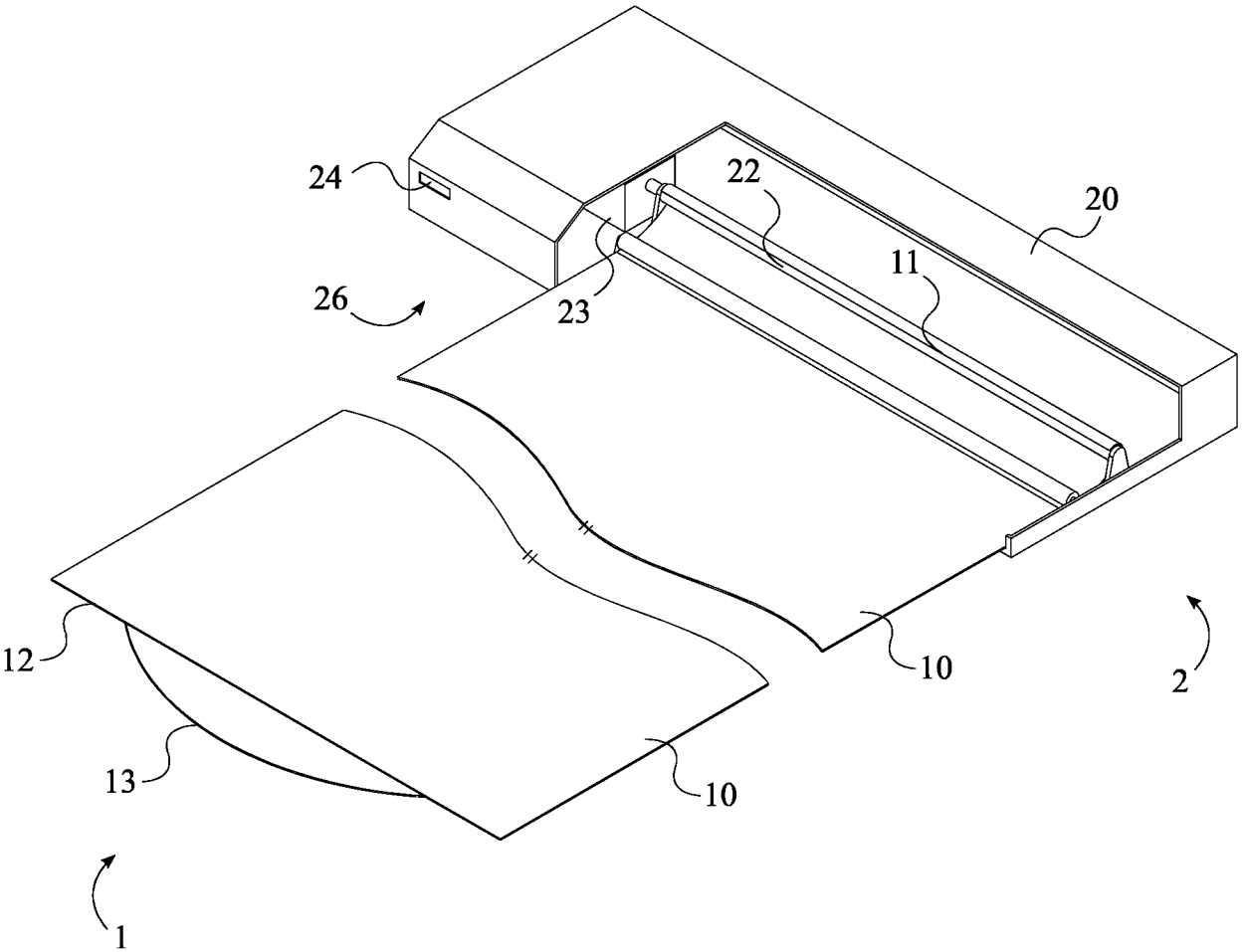
FIG. 14 is a sectional view depicting the fixed end of the aisle runner being connected to the runner roller.

The aisle runner 1 is a decorative length of material that is laid across the chosen walking surface and may be designed for use in many events, such as weddings, red carpet events, proms, church affairs, businesses, schools, community events, etc. A variety of materials may be used to construct the aisle runner 1 in a variety of colors and designs. Graphics such as logos or celebratory messages may also be printed, embroidered, or otherwise displayed along the aisle runner 1. The aisle runner 1 comprises a runner body 10, a fixed end 11, and a free end 12; the runner body 10 being the length of material in the chosen design, and the fixed end 11 and the free end 12 being positioned opposite each other along the runner body 10. The runner body 10 is wound within the automated control unit 2 as depicted in FIG. 13, wherein the fixed end 11 provides an anchored connection to the automated control unit 2 as depicted in FIG. 14. Meanwhile, the free end 12 is the terminal end of the aisle runner 1 that is extended away from the automated control unit 2 by the mobile runner extender 8 when the aisle runner 1 is dispensed. As such, the free end 12 is selectively engaged with the mobile runner extender 8.

In reference to FIG. 13, the automated control unit 2 provides a containment unit for the aisle runner 1 and controls the retraction of the aisle runner 1, and in some embodiments the extension of the aisle runner 1. The automated control unit 2 may be self-standing on the ground or may be wall mounted, depending on the embodiment. The automated control unit 2 comprises a housing 20, a runner feed opening 21, a runner roller 22, a retraction mechanism 26. The housing 20 encases the aisle runner 1, wherein the runner body 10 is disposed around the runner roller 22. The runner roller 22 is rotatably mounted within the housing 20, such that the runner body 10 can be wound and unwound from the runner roller 22 by rotating the runner roller 22. The retractions mechanism is operably coupled to the runner roller 22, wherein the retraction mechanism 26 controls rotation of the runner roller 22. In some embodiments, the retraction mechanism 26 is configured to rotate the runner roller 22 in a single direction, such that the aisle runner 1 is retracted into the housing 20. In other embodiments, the retraction mechanism 26 may be configured to rotate the runner roller 22 in two directions, such that the retraction mechanism 26 may be used to both extend and retract the aisle runner 1.

The runner feed opening 21 traverses through the housing 20 and provides an open section through which the aisle runner 1 may be dispensed and retracted. As the runner body 10 is unwound from the runner roller 22, the runner body 10 is expelled from the housing 20 through the runner feed opening 21; the free end 12 first traversing through the runner feed opening 21. When the runner body 10 is wound around the runner roller 22, the runner body 10 is retracted into the housing 20 through the runner feed opening 21. The runner feed opening 21 is sufficiently large to allow the runner body 10 to smoothly traverse through the runner feed opening 21, without the runner body 10 becoming tangled or distraught.

Figure 1:
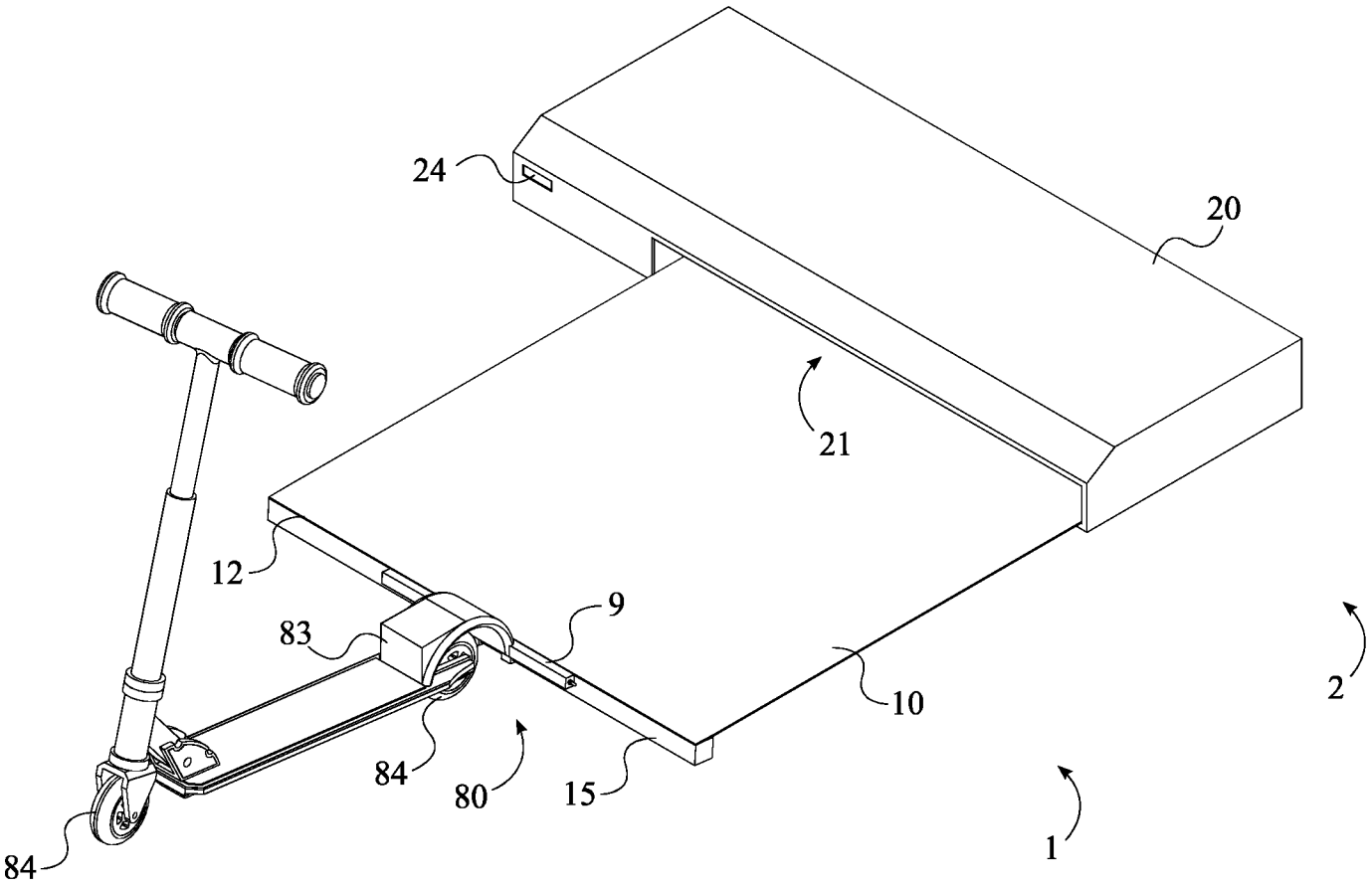
FIG. 1 is a perspective view of the present invention, wherein the aisle runner is being deployed from the automated control unit using the mobile runner extender.

In reference to FIG. 1, the mobile runner extender 8 is a device that engages with the free end 12 of the aisle runner 1 and moves away from the automated control unit 2 in order to extend the aisle runner 1 out from the automated control unit 2. The mobile runner extender 8 may be an autonomous device or a manually operated device, depending on the embodiment of the present invention. The free end 12 is selectively engaged with the mobile runner extender 8, such that the aisle runner 1 may be detached from the mobile runner extender 8 once the aisle runner 1 has been fully extended. However, in some embodiments, the mobile runner extender 8 may remain affixed to the free end 12 once the aisle runner 1 has been fully extended.

In some embodiments the mobile runner extender 8 comprises a mobile motor 83 and a plurality of wheels 84, wherein one or more of the plurality of wheels 84 is driven by the mobile motor 83. In reference to FIG. 1, in one embodiment, the mobile runner extender 8 is a scooter, wherein the plurality of wheels 84 includes a front wheel and a rear wheel. The mobile motor 83 is operably coupled to the rear wheel in order to push the scooter forward. The mobile motor 83 may be actuated by controls on the handle bars of the scooter. The scooter is operated by a user, wherein the user stands on the scooter and navigates by actuating the mobile motor 83 and using the handle bars to steer.

Figure 3:
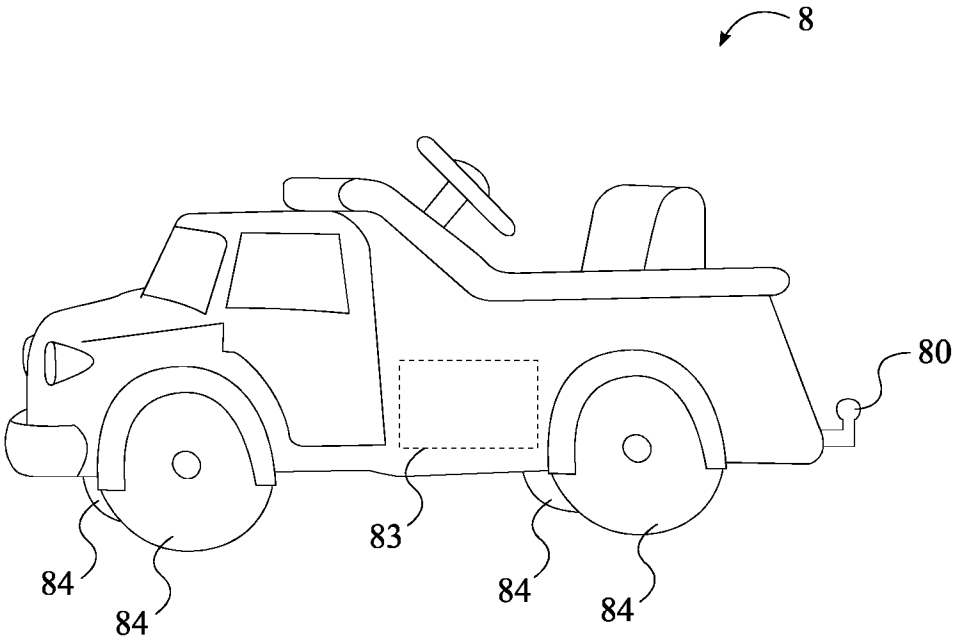
FIG. 3 is a depiction of an alternative embodiment of the mobile runner extender.
Figure 4:
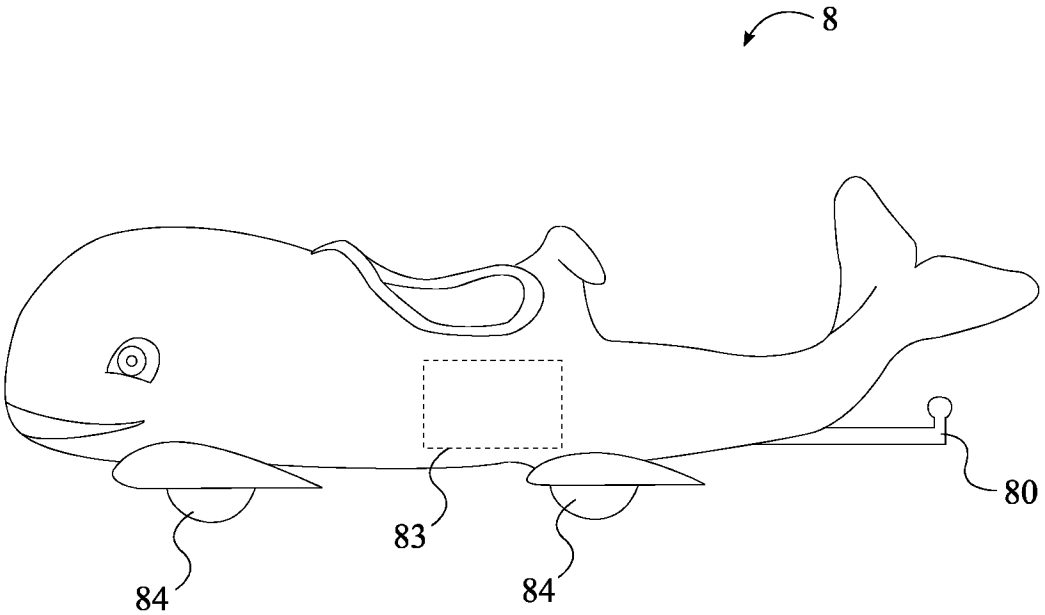
FIG. 4 is a depiction of yet another alternative embodiment of the mobile runner extender.

In reference to FIG. 3-4, in other embodiments, the mobile runner extender 8 may be a vehicle in which the user may be seated. In such embodiments, the plurality of wheels 84 may include three or more wheels. Various hand or foot controls may be provided within the interior of the mobile runner extender 8, allowing the user to actuate the mobile motor 83. A steering wheel, or similar apparatus, may be provided to manipulate one or more of the plurality of wheels 84 in order to steer the mobile runner extender 8.

The design of the plurality of wheels 84 of the mobile runner extender 8 may vary depending on the surface the aisle runner 1 is intended to be deployed on. For example, in one instance the aisle runner 1 may be deployed on sand, while in other instances the aisle runner 1 may be deployed on carpet, grass, hard flooring, etc. Thus, parameters of the plurality of wheels 84 such as the size of each of the plurality of wheels 84, the traction of each of the plurality of wheels 84, and the treads on each of the plurality of wheels 84 may vary from one embodiment to another.

In some embodiments, the mobile runner extender 8 may further comprise a control circuit and a transceiver. The transceiver is electronically connected to the control circuit, while the control circuit is operably connected to the mobile motor 83. A remote-control device is further provided, wherein the remote-control device is wirelessly connected to the transceiver. The user may use the remote-control device to control the mobile runner extender 8 from a remote location within range of the transceiver. User inputs made through the remote-control device are relayed to the transceiver, wherein the signals are processed by the control circuit. The control circuit then actuates the mobile motor 83 in a corresponding manner to navigate the mobile runner extender 8.

In yet other embodiments, the mobile runner extender 8 may be a drone, wherein the mobile runner extender 8 is able to navigate independent of any user input. In such embodiments, the mobile runner extender 8 may include navigational equipment, such as cameras or sensors, to detect and avoid environmental objects. The mobile runner extender 8 may be an aerial drone or a land drone depending on the embodiment of the present invention. In embodiments where the mobile runner extender 8 is an aerial drone, the mobile runner extender 8 may include one or more propellers driven by one or more motors, such that the mobile runner extender 8 may hover and navigate through the air.

In yet other embodiments, the mobile runner extender 8 may be a non-controllable, non-smart device. In such embodiments, the mobile runner extender 8 is able to impart a force on the aisle runner 1 in order to extend the aisle runner 1 from the automated control unit 2. However, the user is unable to provide inputs to control the mobile runner extender 8, and the mobile runner extender 8 is unable to navigate by gathering environmental data. As an example, the mobile runner extender 8 may be one or more helium balloons, wherein the one or more balloons is held in place by the user or a release mechanism. Once released, the one or more balloons drift away from the automated control unit 2, thus pulling the aisle runner 1 from the automated control unit 2.

In some embodiments, the aisle runner 1 may be utilized as a vertical banner display post-deployment. As such and in reference to FIG. 24, a vertical deployment device 86 may be provided to lift the aisle runner 1 from a horizontal position to a vertical position. The vertical deployment device 86 is adjacently connected to the free end 12 of the aisle runner 1, such that the aisle runner 1 pivots about the runner feed opening 21 as the aisle runner 1 is lifted into the air by the vertical deployment device 86. In some embodiments, the vertical deployment device 86 may be attached to the aisle runner 1 after the aisle runner 1 has been extended horizontally by the mobile runner extender 80. In other embodiments, the vertical deployment device 86 may be attached to the aisle runner 1 before the aisle runner 1 has been extended horizontally by the mobile runner extender 80, wherein the mobile runner extender 80 pulls the vertical deployment device 86 along with the aisle runner 1. In order to allow the vertical deployment device 86 to lift the aisle runner 1, the mobile runner extender 80 may first be detached from the aisle runner 1, such that the free end 12 may pivot upwards.

Figure 24:
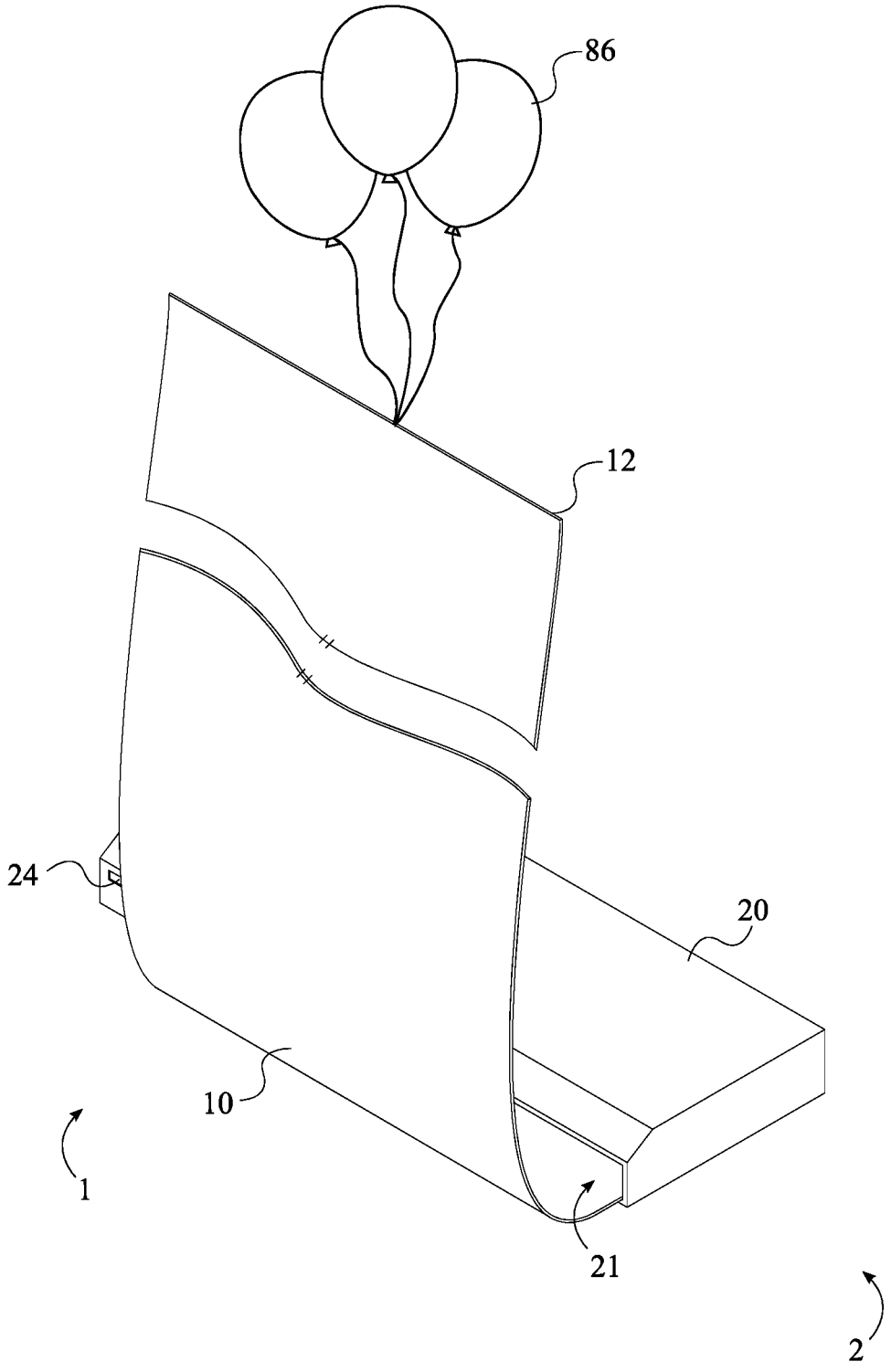
FIG. 24 is a perspective view of the present invention, wherein the vertical deployment device is adjacently connected to the aisle runner, to lift the aisle runner in the vertical position.

In some embodiments, the vertical deployment device 86 is a set of helium balloons, as depicted in FIG. 24. When the mobile runner extender 80 is detached from the aisle runner 1, the set of balloons are able to rise freely, pulling the aisle runner 1 upwards into a vertical position. In other embodiments, the vertical deployment device 86 is a drone. When the mobile runner extender 80 is detached from the aisle runner 1, the drone is able to navigate upwards, pulling the aisle runner 1 upwards into the vertical position. The drone may be controlled remotely by an individual, be programmed to follow a pre-defined path, or be programmed to navigate independent of user input. It is also possible for the mobile runner extender 80 and the vertical deployment device 86 to be provided as a single unit, such as a drone, wherein the single unit is capable of pulling the aisle runner out in a horizontal position and then pivoting the aisle runner 1 upwards into the vertical position.

Figure 25:
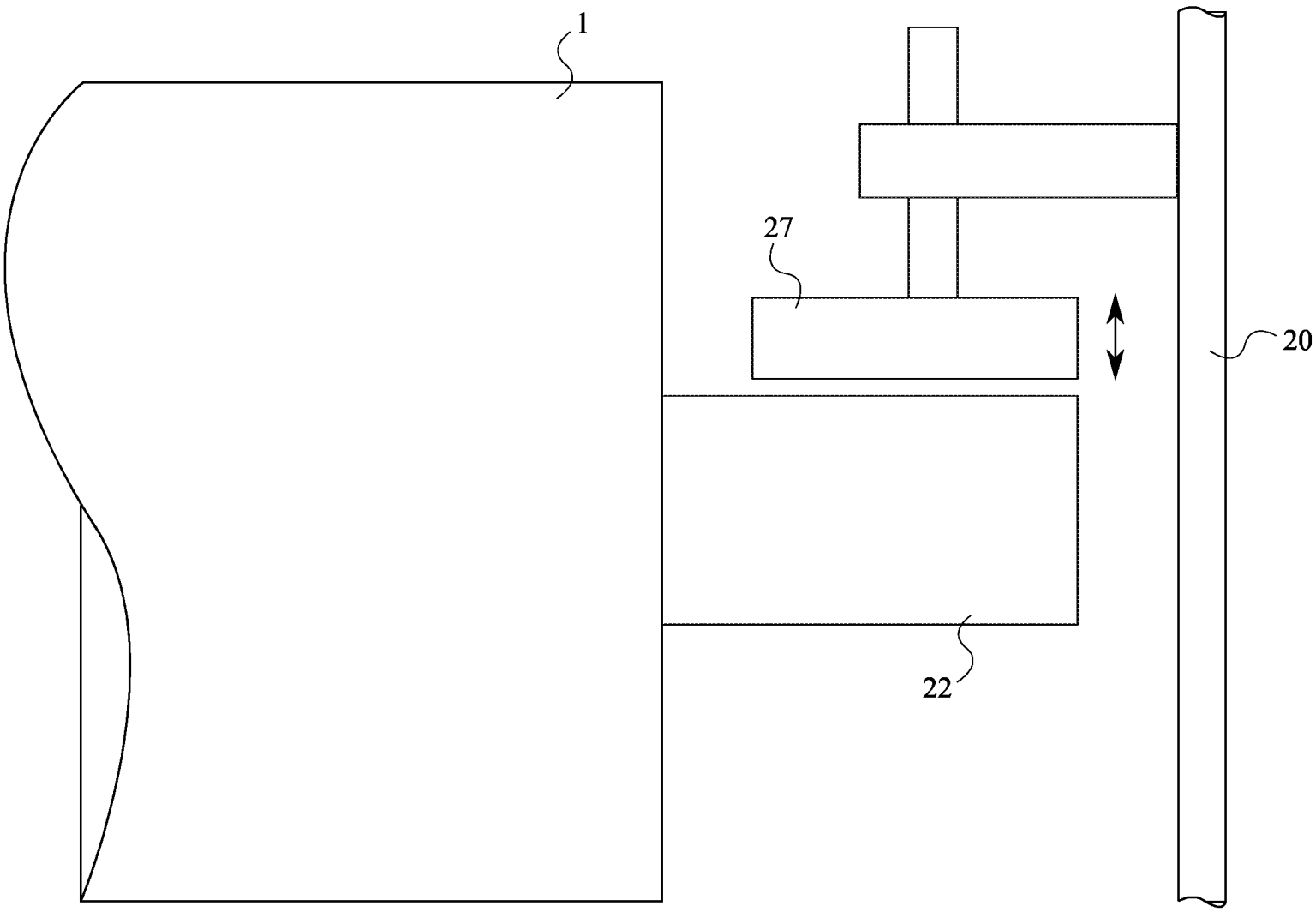
FIG. 25 is a diagram depicting the locking mechanism and the runner roller, wherein the locking mechanism can be selectively engaged with the runner roller.

In reference to FIG. 25, the automated control unit 2 may further comprise a locking mechanism 27. The locking mechanism 27 is mounted within the housing 20 and is used to selectively engage with the runner roller 22 in order to prevent further rotation of the runner roller 22. The locking mechanism 27 can be used to both prevent further horizontal extension of the aisle runner 1 and assist in allowing the aisle runner 1 to pivot upwards to the vertical position. By preventing further extension of the aisle runner 1, the locking mechanism 27 helps ensure that the aisle runner 1 remains taut. Furthermore, this allows the aisle runner 1 to be pivoted up to the vertical position without an additional portion of the aisle runner 1 being extender from the automated control unit 2.

The locking mechanism 27 can be integrated with the runner roller 22 in a number of ways. In some embodiments, the locking mechanism 27 provides a solenoid lock, wherein the locking mechanism 27 includes a pin that is extended outwards to engage with the runner roller 22 and retard the movement of the runner roller 22. In other embodiments, a linear actuator, rotary actuator, or similar device may be used to drive the pin, or other mechanism, that engages with the runner roller 22. In yet other embodiments, the locking mechanism 27 may provide a caliper lock, wherein the locking mechanism 27 includes two pads that are positioned about opposite sides of the runner roller 22 or an extension thereof. The two pads are clamped together, gripping the runner roller 22, thus preventing further rotation of the runner roller 22.

In order to attach the aisle runner to the mobile runner extender 8, the mobile runner extender 8 comprises a runner receiver 80, while the aisle runner 1 comprises an extender mount 15. The extender mount 15 is integrated with the free end, such that the free end may be mounted to the runner receiver 80. Preferably, the extender mount 15 is removably attached to the mobile runner extender 8. However, in some embodiments, the extender mount 15 may be permanently affixed to the mobile runner extender 8. Together, the runner receiver 80 and the extender mount 15 provide a secure connection between the mobile runner extender 8 and the aisle runner 1, such that the mobile runner extender 8 may deploy the aisle runner 1 from the automated control unit 2.

Figure 2:
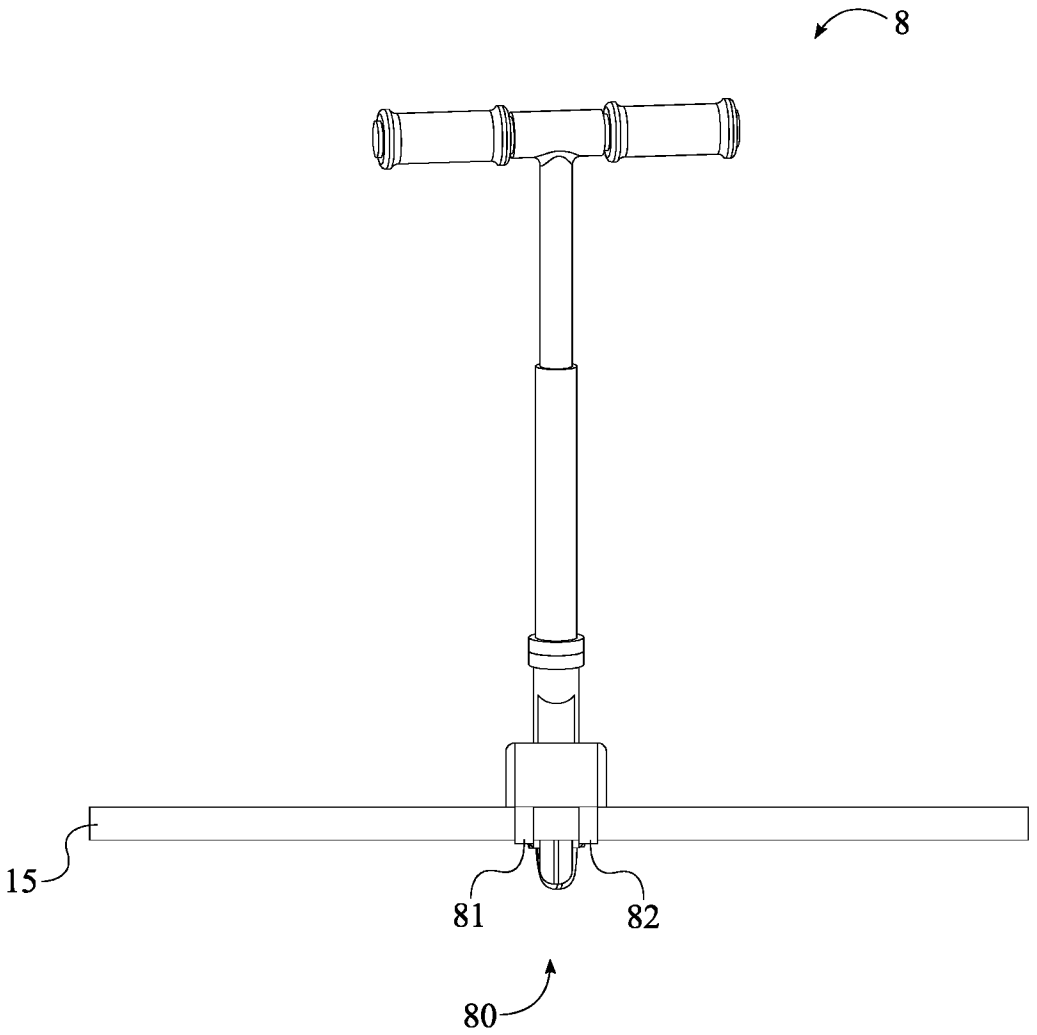
FIG. 2 is a rear view of the mobile runner extender in one embodiment, wherein the first bracket and a second bracket form the runner receiver.

In reference to FIG. 2, in some embodiments, the runner receiver 80 comprises a first bracket 81 and a second bracket 82. The first bracket 81 is positioned adjacent to the second bracket 82, such that the free end may be supported by both the first bracket 81 and the second bracket 82. Meanwhile, the extender mount 15 is a bar that is slotted into the first bracket 81 and the second bracket 82. The extender mount 15 is positioned across the free end 12, such that the aisle runner 1 is kept in tension and deploys in a flat manner. The runner receiver 80 may further include a magnetic bar that is supported by the first bracket 81 and the second bracket 82. In such embodiments, the extender mount 15 may be constructed from a metallic material or have metallic properties, such that the extender mount 15 may be magnetically secured to the magnetic bar. This provides additional security and stability as the aisle runner 1 is deployed by preventing the extender mount 15 from sliding side to side within the runner receiver 80.

In other embodiments, the extender mount 15 and the runner receiver 80 may be formed by various other linkages that allow the mobile runner extender 8 to selectively engage with the aisle runner 1. For example, in some embodiments the runner receiver 80 and the extender mount 15 may form a trailer hitch joint. Other types of fasteners that may be used to secure the aisle runner 1 to the mobile runner extender 8 include, but are not limited to, bolts, buckles, clamps, ties, clasps, clips, grommets, hook-and-eye closures, latches, pins, rivets, snaps, and straps.

The retraction mechanism 26 is used to retract the aisle runner 1 into the automated control unit 2 once the aisle runner 1 is no longer needed. Depending on the embodiment, the retraction mechanism 26 may be manually operated or may be automated. In some embodiments where the retraction mechanism 26 is manually operated, the retraction mechanism 26 may be a hand crank, wherein the runner roller 22 is mounted to the retraction mechanism 26. As such, when the user rotates the handle of the hand crank, the runner roller 22 is simultaneously rotated within the housing 20, wherein the aisle runner 1 is wound around the runner roller 22 and pulled into the housing 20.

In embodiments where the retraction mechanism 26 is automated, the retraction mechanism 26 may comprise a motor 23 and an actuator 24. The runner roller 22 is rotatably coupled to the motor 23 and is rotatably mounted within the housing 20, such that the runner body 10 can be wound and unwound from the runner roller 22 by rotating the runner roller 22. The motor 23 is operably coupled to the actuator 24 in order to control the rotational direction and speed of the motor 23, and in turn the rotational direction and speed of the runner roller 22; the motor 23 driving the rotation of the runner roller 22.

The actuator 24 is a control that dictates the supply of power to the motor 23 in order to rotate the runner roller 22 and wind or unwind the runner body 10. In one embodiment of the present invention, the actuator 24 is a power switch, wherein a user can manually turn the motor 23 on and off, as well as dictate the rotational direction of the motor 23. In another embodiment of the present invention, the actuator 24 is a motion sensor, wherein the motion sensor detects movement and extends or retracts the runner body 10. In yet other embodiments of the present invention, the power switch may be used in combination with the motion sensor, wherein the power switch dictates the rotational direction of the motor 23, while the motion sensor dictates the extension or retraction of the runner body 10.

In some embodiments, the present invention may further comprise a guide assembly to assist the automated control unit 2 in dispensing and retracting the runner body 10. The guide assembly helps to maintain the runner body 10 in a smooth, untangled formation, such that the runner body 10 can be readily unwound from or wound around the runner roller 22. The guide assembly has many configurations and may include a guide wheel 30, a subsequent guide wheel 32, a guide wire 40, a subsequent guide wire 42, a wire roller 50, a guide track 60, and a subsequent guide track 62. The specific configuration may depend on the needs of the user and/or the type of material of the aisle runner 1.

Figure 12:
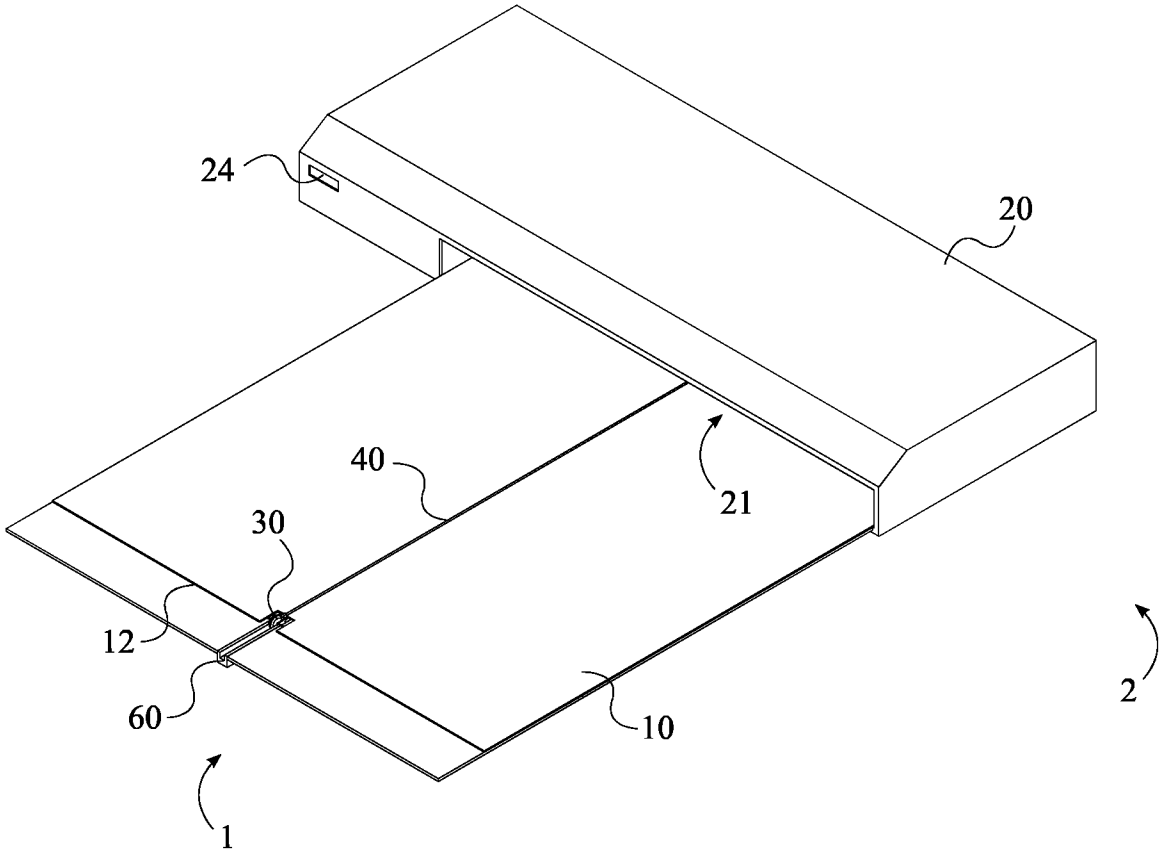
FIG. 12 is a perspective view depicting the guide wheel being centrally positioned about the runner body.

In reference to FIG. 12, in a first embodiment, the guide wheel 30 is rotatably connected to the runner body 10 and is positioned about the free end 12. More specifically, the guide wheel 30 is centrally positioned along the free end 12. Meanwhile, the wire roller 50 is rotatably mounted within the housing 20 and positioned in between the runner roller 22 and the runner feed opening 21. The guide wire 40 is terminally connected to the wire roller 50 and the guide wheel 30, wherein the guide wire 40 is coiled around the wire roller 50. The guide wheel 30 assists the runner body 10 is traversing across the ground as the runner body 10 is extended or retracted from the housing 20, and helps direct the runner body 10 in a straight line. As the runner body 10 is extended, the guide wire 40 is uncoiled from the wire roller 50. Meanwhile, as the runner body 10 is retracted, the guide wire 40 is coiled around the wire roller 50. The wire roller 50 may be motorized or rotatably coupled to the runner roller 22 in order to coil and uncoil the guide wire 40.

Figure 9:
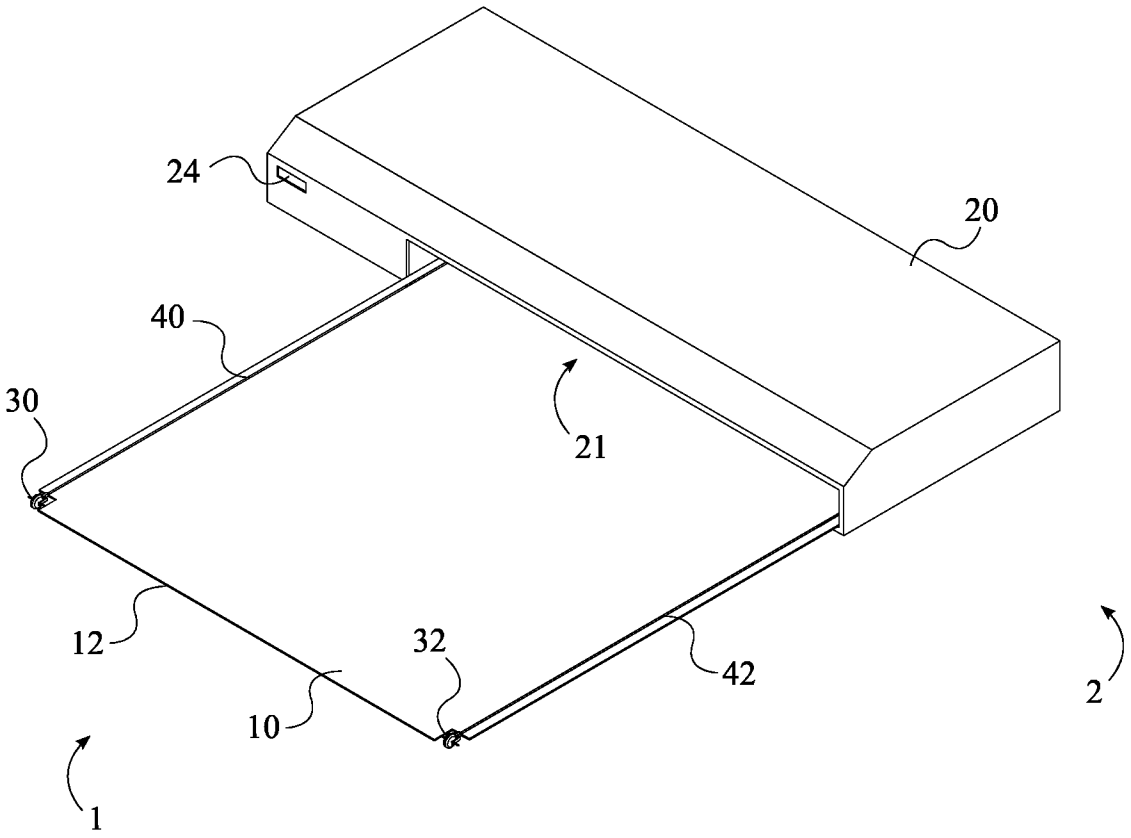
FIG. 9 is a perspective view depicting the guide wire being connected to the guide wheel and the subsequent guide wire being connected to the subsequent guide wheel.
Figure 10:
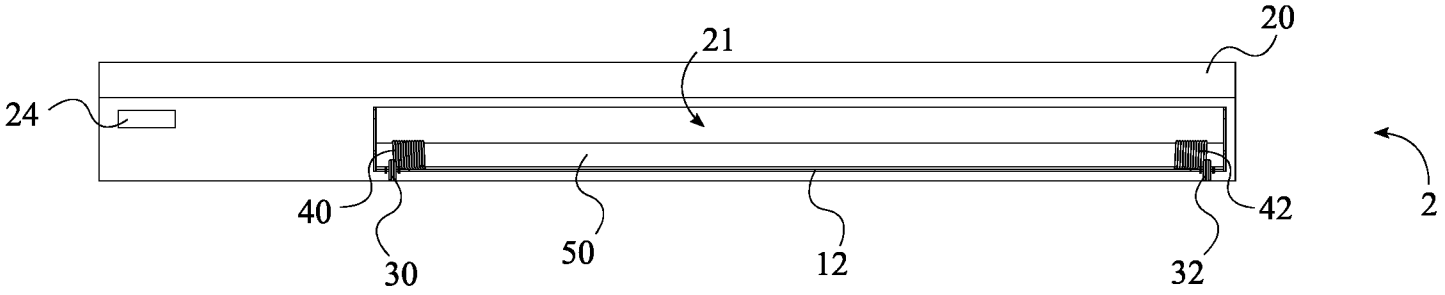
FIG. 10 is a front elevational view depicting the guide wire and the subsequent guide wire being coiled around the wire roller.

In reference to FIG. 9-10, in a second embodiment, the subsequent guide wheel 32 and the subsequent guide wire 42 are used in conjunction with the guide wheel 30 and the guide wire 40. Similar to guide wheel 30, the subsequent guide wheel 32 is rotatably connected to the runner body 10 and is positioned about the free end 12. The subsequent guide wire 42 is terminally connected to the wire roller 50 and the subsequent guide wheel 32, wherein the subsequent guide wire 42 is coiled around the wire roller 50. The subsequent guide wheel 32 is positioned opposite the guide wheel 30 across the free end 12, such that the guide wire 40 and the subsequent guide wire 42 traverse along opposite sides of the runner body 10. The guide wheel 30 and the subsequent guide wheel 32 assist the runner body 10 is traversing across the ground as the runner body 10 is extended or retracted from the housing 20, and help direct the runner body 10 in a straight line. As the runner body 10 is extended, the guide wire 40 and the subsequent guide wire 42 are uncoiled from the wire roller 50. Meanwhile, as the runner body 10 is retracted, the guide wire 40 and the subsequent guide wire 42 are coiled around the wire roller 50. The wire roller 50 may be motorized or rotatably coupled to the runner roller 22 in order to coil and uncoil the subsequent guide wire 42.

Figure 11:
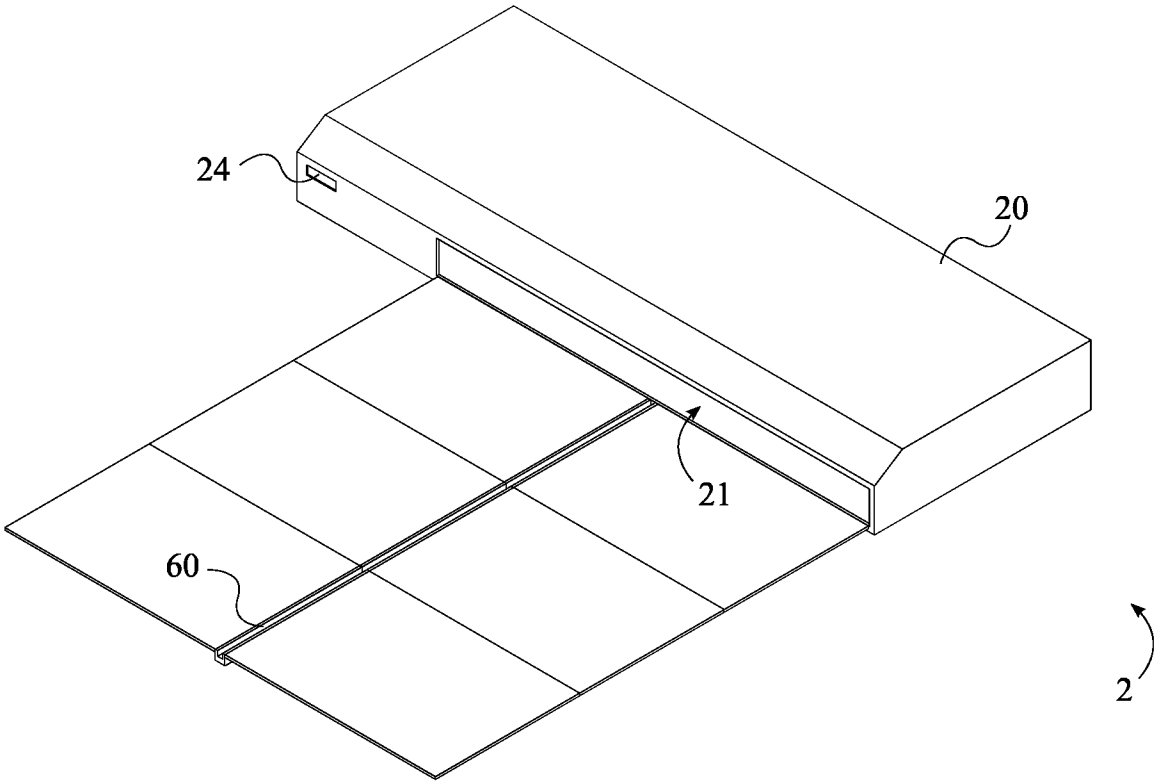
FIG. 11 is perspective view depicting the guide track in conjunction with the support platform, wherein the guide track is centrally positioned.

In a third embodiment, the guide wheel 30 is rotatably connected to the runner body 10 and is centrally positioned about the free end 12. Meanwhile, the guide track 60 is adjacently connected to the housing 20 and positioned adjacent to the runner feed opening 21 as depicted in FIG. 11. More specifically, the guide track 60 is centrally positioned with the runner feed opening 21. The guide wheel 30 is linearly retained by the guide track 60, such that as the runner body 10 is extended from or retracted into the housing 20, the guide wheel 30 linearly traverses along the guide track 60 away from or towards the housing 20. As such, the guide track 60, in combination with the guide wheel 30, assists in extending or retracting the runner body 10 in a straight, smooth manner.

Figure 5:
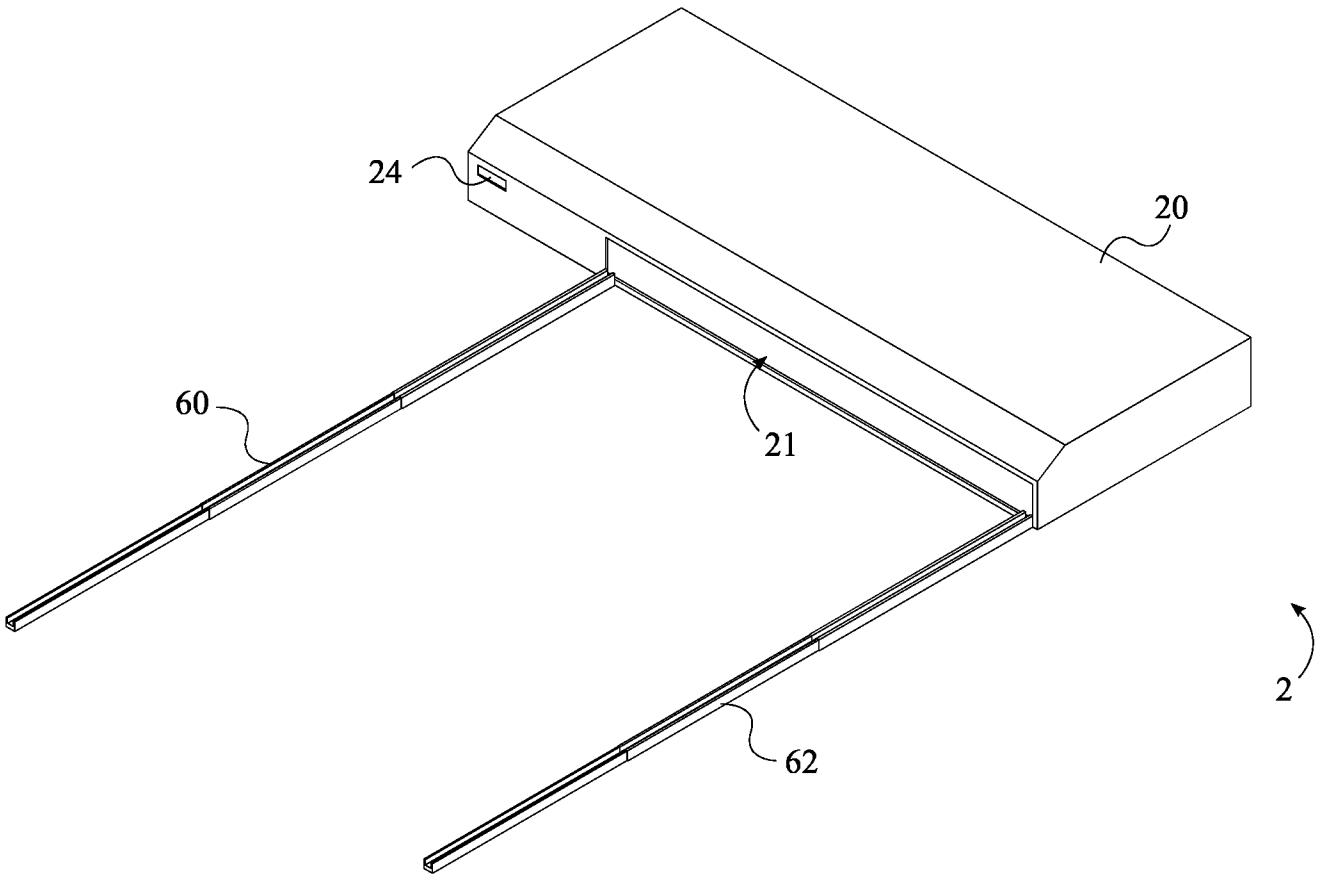
FIG. 5 is a perspective view depicting the guide track and the subsequent guide track being telescopically extended.
Figure 6:
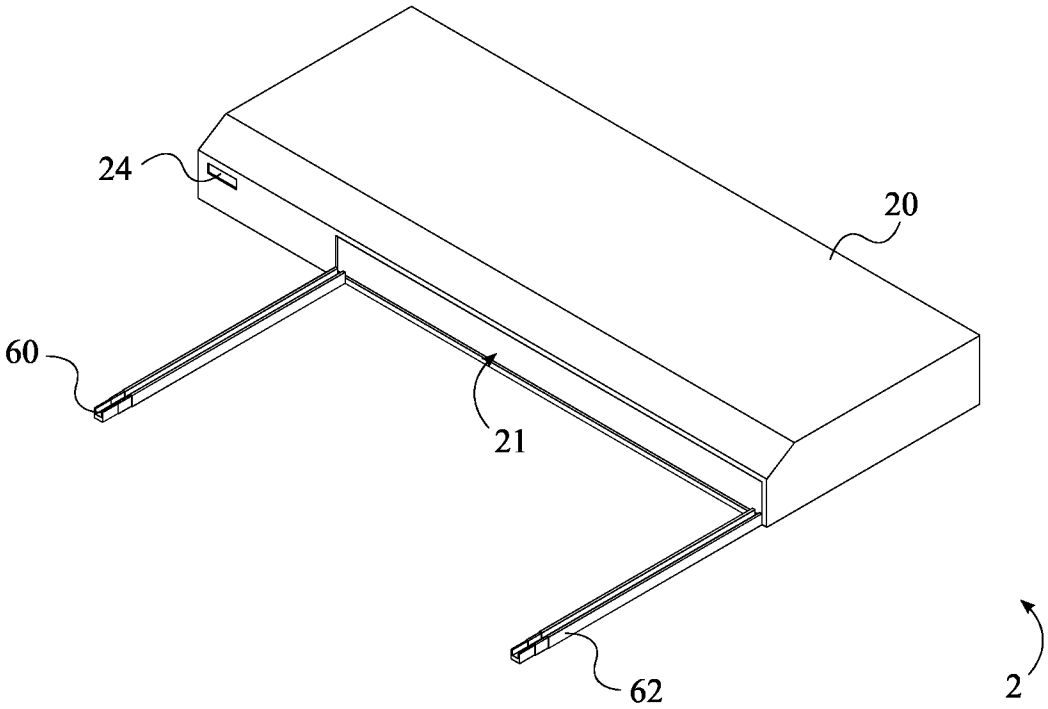
FIG. 6 is a perspective view depicting the guide track and the subsequent guide track being telescopically retracted.
Figure 7:
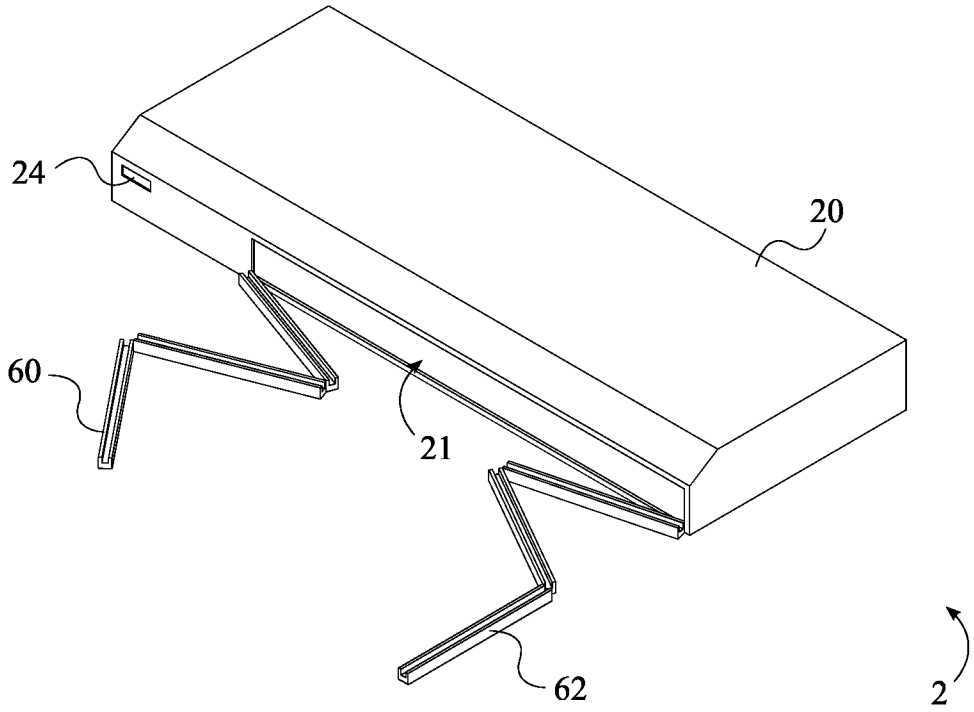
FIG. 7 is a perspective view depicting the guide track and the subsequent guide track being hingedly collapsible.

The guide track 60 is designed to be collapsible, such that the guide track 60 can be made more compact for transportation and storage when the aisle runner 1 is not deployed. The guide track 60 can be designed to be collapsible in many ways. In one embodiment, the guide track 60 is telescopically collapsible as depicted in FIG. 5-6, wherein the guide track 60 comprises a plurality of sections. Adjacent sections of the plurality of sections are slidably engaged with each other, allowing the guide track 60 to be extended and retracted. In another embodiment, the guide track 60 is hingedly collapsible as depicted in FIG. 7, wherein the guide track 60 again comprises the plurality of sections. However, in the hingedly collapsible configuration, the adjacent sections are hingedly connected to each other, such that the guide track 60 can be folded and unfolded by pivoting each of the plurality of sections.

In reference to FIG. 11-12, a support platform may also be utilized in conjunction with the guide track 60. The support platform provides a flat surface that extends away from the housing 20, onto which the runner body 10 is extended. The support platform comprises a first platform and a second platform that are both adjacently connected to the guide track 60. The first platform and the second platform are positioned opposite each other about the guide track 60, wherein the first platform and the second platform traverse along the guide track 60. When using the support platform, the guide track 60 is hingedly collapsible along with the first platform and the second platform. The first platform comprises a first plurality of sections, while the second platform comprises a second plurality of sections; adjacent sections of both the first plurality of sections and the second plurality of sections being hingedly connected to each other. In this way, both the first platform and the second platform are folded and unfolded in conjunction with the guide track 60.

Figure 8:
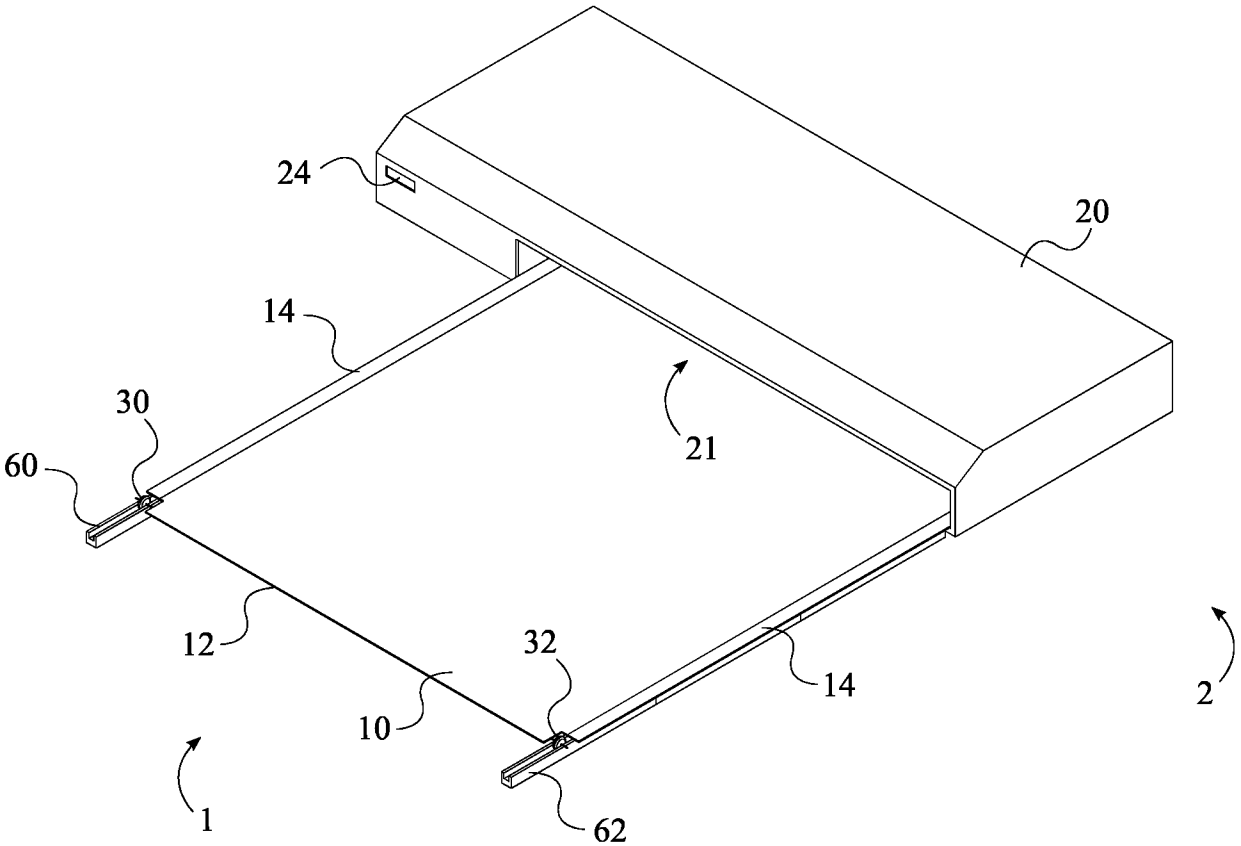
FIG. 8 is a perspective view depicting the aisle runner being extended from the automated housing, wherein the guide wheel is linearly retained by the guide track and the subsequent guide wheel is linearly retained by the subsequent guide track.

In reference to FIG. 8, in a fourth embodiment, the guide wheel 30 and the subsequent guide wheel 32 are rotatably connected to the runner body 10 and are positioned about opposite sides of the free end 12. Meanwhile, the guide track 60 and the subsequent guide track 62 are adjacently connected to the housing 20 and are positioned adjacent to the runner feed opening 21. More specifically, guide track 60 and the subsequent guide track 62 are positioned opposite each other across the runner feed opening 21. Similar to the guide wheel 30 and the guide track 60, the subsequent guide wheel 32 is linearly retained by the subsequent guide track 62, such that as the runner body 10 is extended from or retracted into the housing 20, the subsequent guide wheel 32 linearly traverses along the subsequent guide track 62 away from or towards the housing 20. As such, the guide wheel 30, in combination with the guide track 60, and the subsequent guide track 62, in combination with the subsequent guide wheel 32, assist in extending or retracting the runner body 10 in a straight, smooth manner.

Similar to the guide track 60, the subsequent guide track 62 is designed to be collapsible, such that the subsequent guide track 62 can be made more compact for transportation and storage when the aisle runner 1 is not deployed. The subsequent guide track 62 can be designed to be collapsible in many ways. In one embodiment, the subsequent guide track 62 is telescopically collapsible as depicted in FIG. 5-6, wherein the subsequent guide track 62 comprises a plurality of sections. Adjacent sections of the plurality of sections are slidably engaged with each other, allowing the subsequent guide track 62 to be extended and retracted. In another embodiment, the subsequent guide track 62 is hingedly collapsible as depicted in FIG. 7, wherein the subsequent guide track 62 again comprises the plurality of sections. However, in the hingedly collapsible configuration, the adjacent sections are hingedly connected to each other, such that the subsequent guide track 62 can be folded and unfolded by pivoting each of the plurality of sections.

In reference to FIG. 13-14, in some embodiments, the aisle runner 1 may further comprise a handle 13 that is integrated into the runner body 10 about the free end 12. The handle 13 allows a user to grasp the aisle runner 1 as the runner body 10 is being extended from or retracted into the housing 20. In this way, the user can guide the runner body 10, ensuring that the aisle runner 1 is extended or retracted in a straight, smooth manner. The handle 13 can also be utilized to manually extend the runner body 10 without the use of the motor 23.

Figure 15:
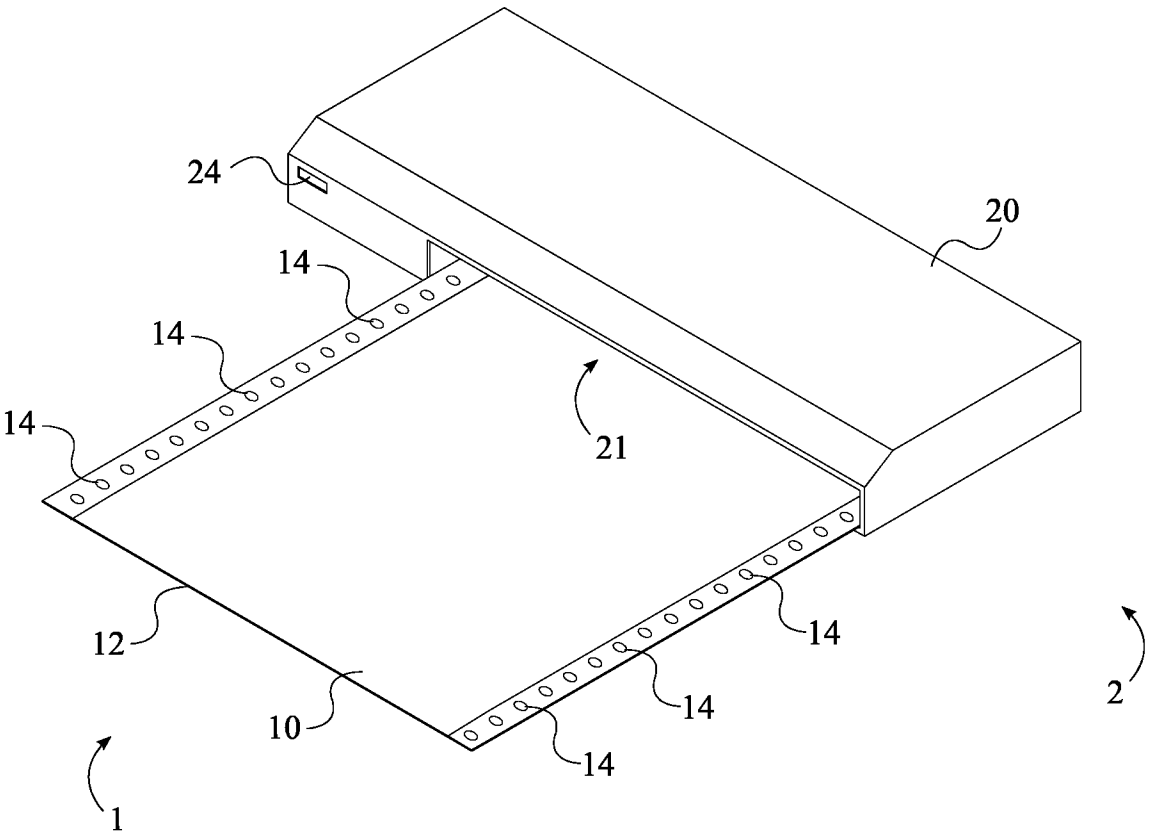
FIG. 15 is a perspective view of the present invention, wherein the plurality of lights is oriented along the perimeter of the aisle runner.
Figure 16:
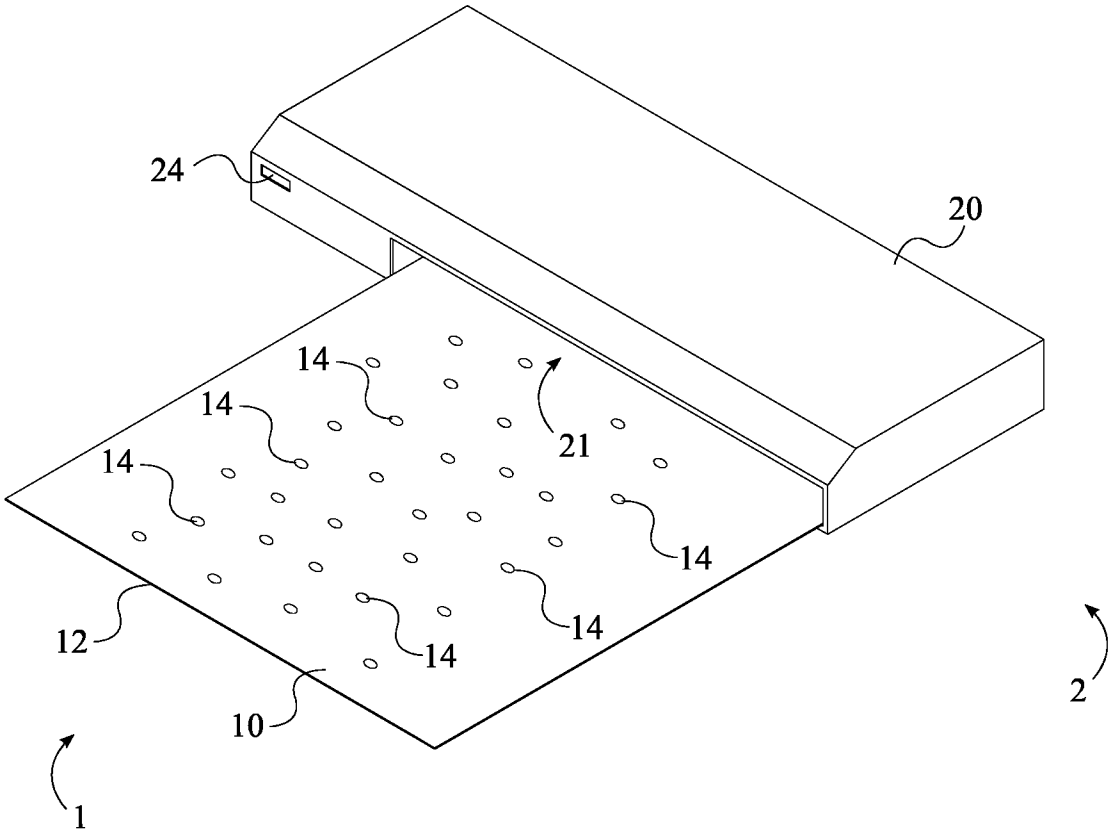
FIG. 16 is a perspective view of the present invention, wherein the plurality of lights is oriented along the center of the aisle runner.

In reference to FIG. 15-16, the aisle runner 1 may further comprise a plurality of lights 14 that provide additional visual effects to the design of the runner body 10. The plurality of lights 14 is distributed along the runner body 10. In some embodiments, the plurality of lights 14 is perimetrically connected to the runner body 10, wherein the plurality of lights 14 illuminates the edges of the runner body 10; the plurality of lights 14 being positioned along both sides of the runner body 10, as depicted in FIG. 15. In other embodiments, the plurality of lights 14 may be disbursed along the center of the runner body 10, or within the perimeter of the runner body 10, as depicted in FIG. 16. In yet other embodiments, the plurality of lights 14 may be positioned along both the perimeter and interior of the runner body 10. Preferably, each of the plurality of lights 14 is a light emitting diode (LED), however, it is possible for other light sources to be utilized. The LED's may by arranged individually or in an LED strip that is positioned along each side of the runner body 10.

Figure 19:
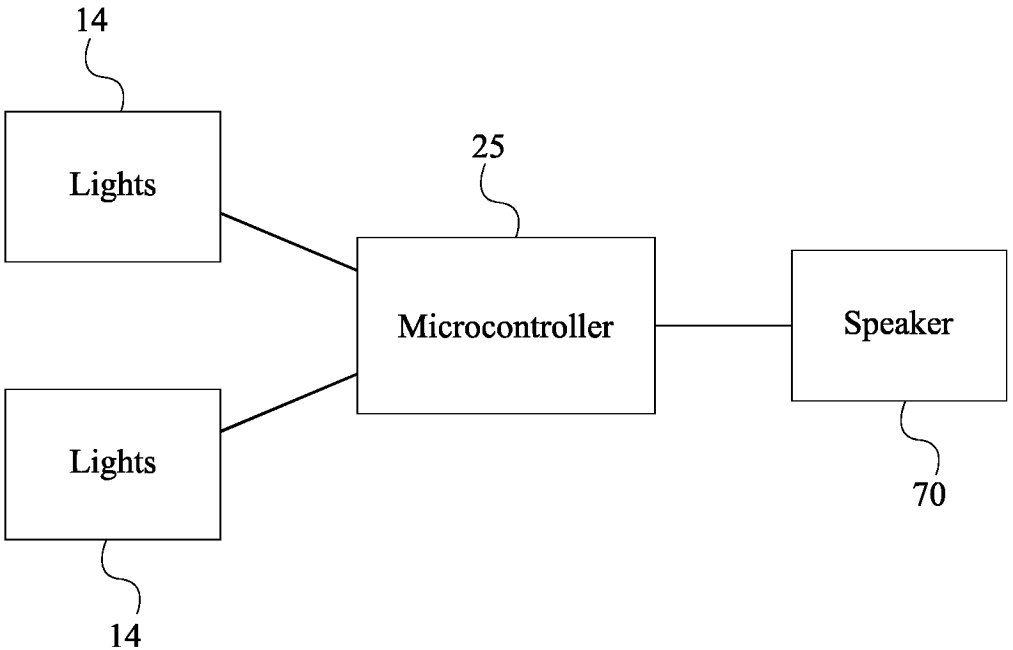
FIG. 19 is a diagram depicting the microcontroller being operably connected to the plurality of lights and the speaker.
Figure 20:
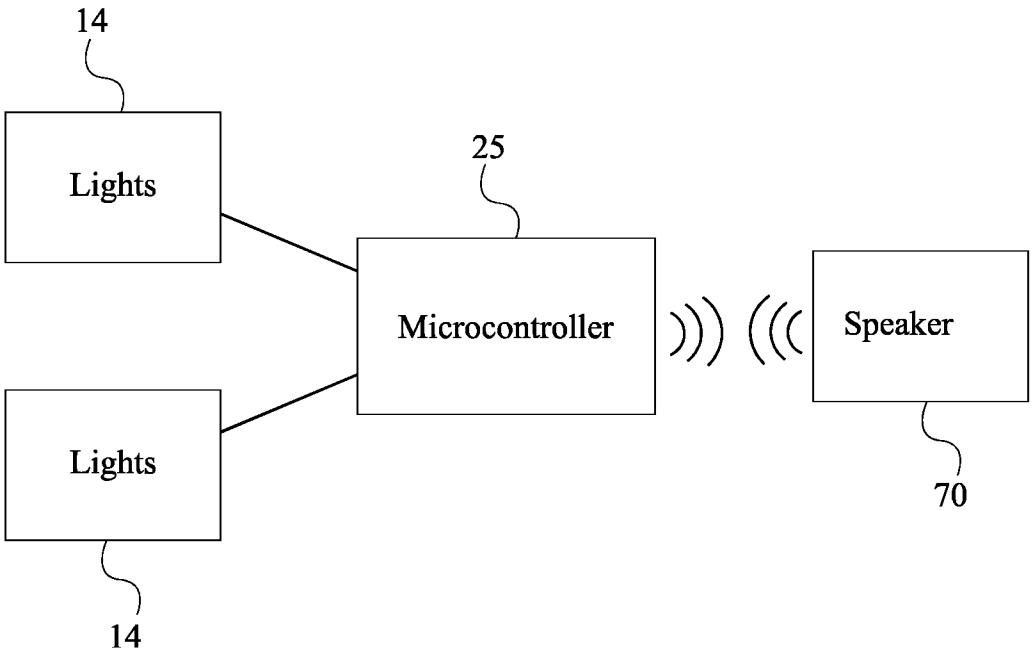
FIG. 20 is a diagram depicting the microcontroller being wirelessly connected to the speaker.

In reference to FIG. 19-20, the automated control unit 2 may further comprise a microcontroller 25 that is positioned within the housing 20 and is operably connected to the plurality of lights 14. The plurality of lights 14 can emit a variety of colors of light and can be configured to constantly illuminate or flash or pulsate in a predetermined pattern. The microcontroller 25 dictates the color of each of the plurality of lights 14 and the pattern in which each of the plurality of lights 14 is illuminated. A control panel may also be provided, allowing a user to select the color of light and the light pattern, wherein the control panel is operably connected to the microcontroller 25.

The microcontroller 25 can also be used to dictate when the plurality of lights 14 is turned on and off. The plurality of lights 14 can be turned off and on through a power switch or using a sensor array that is electrically connected to the microcontroller 25. In one embodiment, the sensor array includes a motion sensor. When the motion sensor detects movement, a signal is relayed to the microcontroller 25, wherein the microcontroller 25 turns the plurality of lights 14 on in the desired pattern. In another embodiment, the sensor array includes a plurality of pressure sensors integrated into the runner body 10. When an individual walks across the runner body 10, the plurality of pressure sensors relays signals back to the microcontroller 25, wherein the microcontroller 25 turns on the plurality of lights 14.

Figure 17:
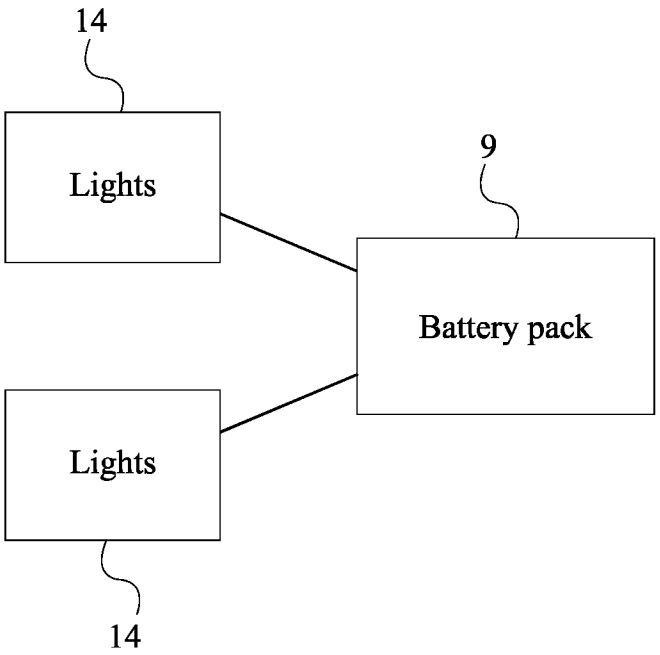
FIG. 17 is a diagram depicting the electrical connection between the battery pack and the plurality of lights.

In some embodiments, the plurality of lights 14 may be powered by a battery pack, wherein the plurality of lights 14 is electrically connected to the battery pack, as depicted in FIG. 17. The battery pack may have an on/off switch, enabling the user to direct or divert electrical current to and from the plurality of lights 14. The battery pack may be rechargeable through a power cord, wireless charging system, or other suitable means. In some embodiments, the battery pack may be integrated with the mobile runner extender 8, wherein the plurality of lights 14 is plugged into the battery pack when the extender mount 15 is secured to the runner receiver 80. The plurality of lights 14 may be electrically connected to the extender mount 15, wherein the extender mount 15 is electrically engaged with the battery pack, when the extender mount 15 is attached to the runner receiver 80.

Figure 18:
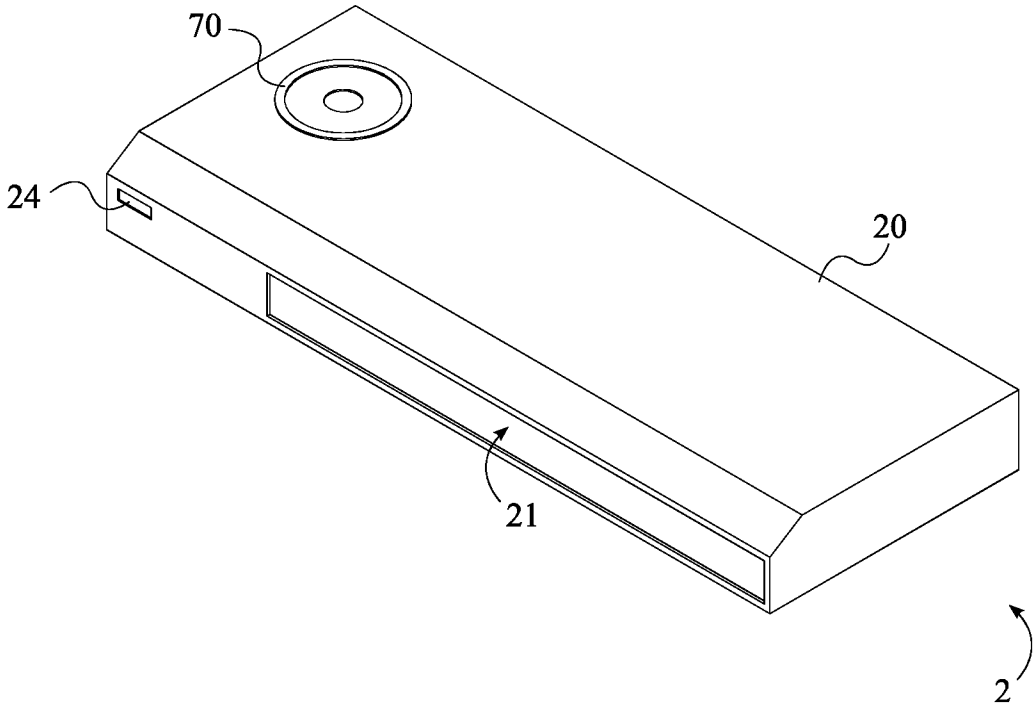
FIG. 18 is a perspective view depicting the speaker being integrated into the housing.

The present invention may further include a speaker 70 that is used to provide audial effects in addition to the visual effects of the runner body 10. The microcontroller 25 is operably connected to the speaker 70 as depicted in FIG. 19, wherein the microcontroller 25 dictates the audio files that are played through the speaker 70. The microcontroller 25 may be preprogrammed with audio files, or audio files may be uploaded to the microcontroller 25. In one embodiment, the speaker 70 is integrated into the housing 20 as depicted in FIG. 18, wherein music or sound effects are played directly from the automated control unit 2. In another embodiment, the speaker 70 is wirelessly connected to the microcontroller 25 as depicted in FIG. 20, such that the speaker 70 can be positioned in a remote location relative to the automated control unit 2.

Figure 21:
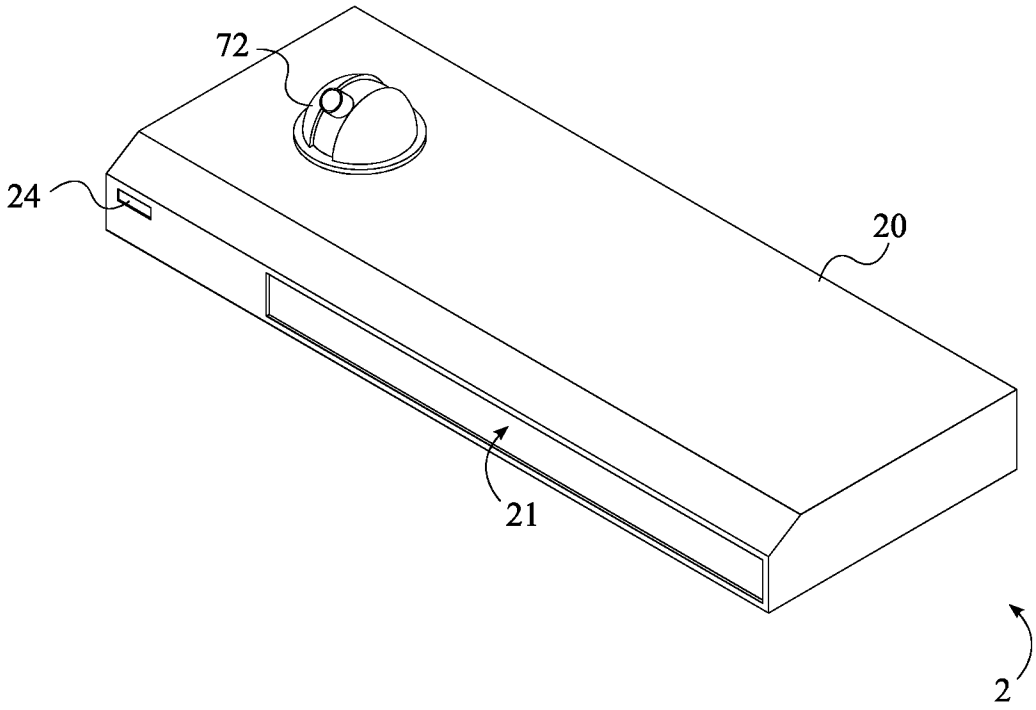
FIG. 21 is a perspective view depicting the projector being integrated into the housing.
Figure 22:
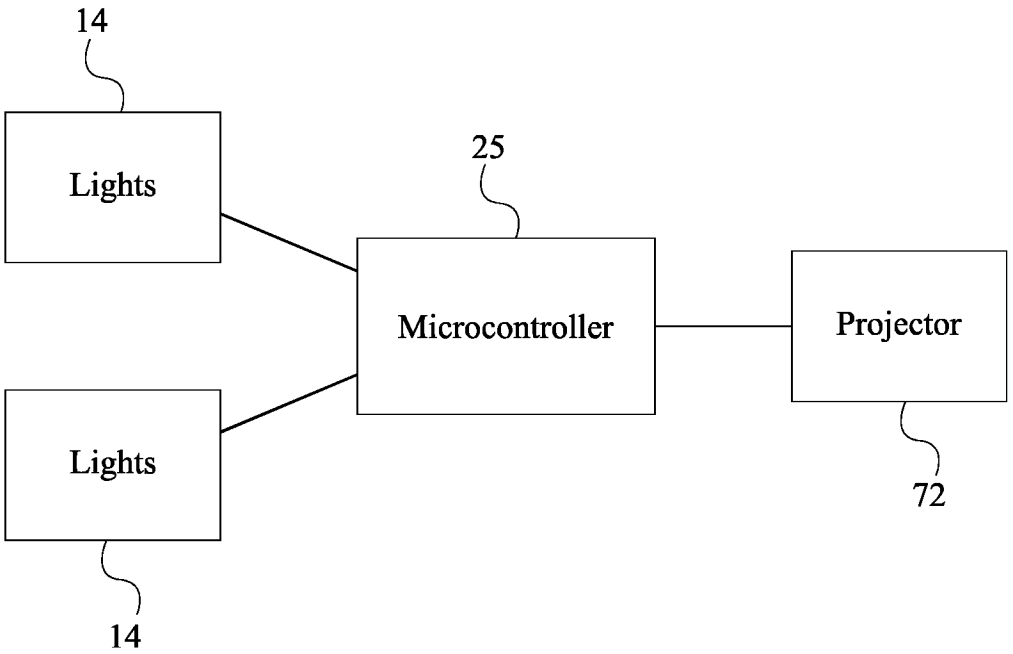
FIG. 22 is a diagram depicting the microcontroller being operably connected to the plurality of lights and the projector.
Figure 23:
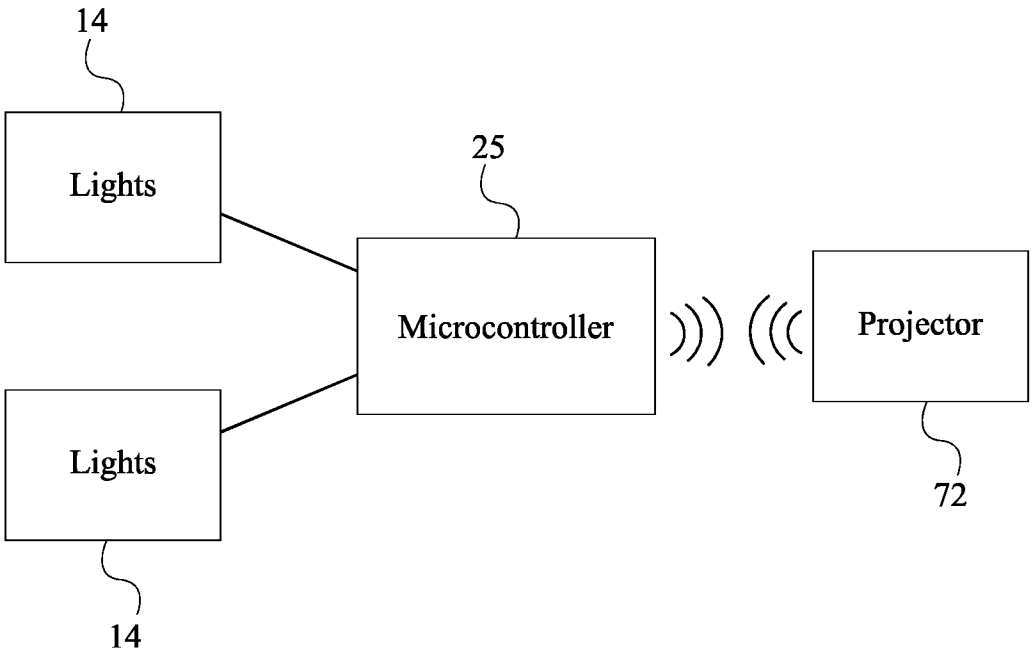
FIG. 23 is a diagram depicting the microcontroller being wirelessly connected to the projector.

The present invention may further include a projector 72 that is used to provide visual effects in addition to the visual effects of the plurality of lights 14. The microcontroller 25 is operably connected to the projector 72 as depicted in FIG. 22, wherein the microcontroller 25 dictates the image or video files that are played through the projector 72. The microcontroller 25 may be preprogrammed with image or video files, or image or video files may be uploaded to the microcontroller 25. In one embodiment, the projector 72 is integrated into the housing 20 as depicted in FIG. 21, wherein visual effects are played directly from the automated control unit 2. In another embodiment, the projector 72 is wirelessly connected to the microcontroller 25 as depicted in FIG. 23, such that the projector 72 can be positioned in a remote location relative to the automated control unit 2.

Some embodiments of the present invention may further include a three-dimensional (3D) hologram display unit. The 3D hologram display unit is utilized to project 3D images on or around the aisle runner 1. The 3D hologram display unit can be integrated into the aisle runner 1, the automated control unit 2, or both.

Other optional components for the present invention include a remote control, a cleaning kit, and a storage bag. The remote control allows a user to wirelessly interact with the microcontroller 25 in order to control the plurality of lights 14, the speaker 70, and the extension or retraction of the aisle runner 1. Meanwhile, the cleaning kit provides the necessary equipment for maintaining the automated control unit 2 and the aisle runner 1 in working order. The storage bag provides an enclosure to hold, transport, and store the automated control unit 2 in, while the aisle runner 1 is in the retracted position.

Although the invention has been explained in relation to its preferred embodiment, it is to be understood that many other possible modifications and variations can be made without departing from the spirit and scope of the invention as hereinafter claimed.

What is claimed is:

1. An automated aisle runner comprises:
an aisle runner;
an automated control unit;
a mobile runner extender;
the aisle runner comprising a runner body, a fixed end, and a free end;
the automated control unit comprising a housing, a runner feed opening, a runner roller, and a retraction mechanism;
the runner feed opening traversing through the housing;
the runner roller being rotatably mounted within the housing;
the retraction mechanism being operably coupled to the runner roller to control rotation of the runner roller;
the fixed end and the free end being terminally positioned opposite each other along the runner body;
the fixed end being adjacently connected to the roller body;
the runner body being disposed about the runner roller; and
the free end being selectively engaged with the mobile runner extender.

2. The automated aisle runner as claimed in claim 1 comprises:
the mobile runner extender comprising a runner receiver; and
the free end being mounted onto the runner receiver.

3. The automated aisle runner as claimed in claim 2 comprises:
the runner receiver comprising a first bracket and a second bracket;
the first bracket being positioned adjacent to the second bracket; and
the free end being supported by the first bracket and the second bracket.

4. The automated aisle runner as claimed in claim 1 comprises:
the aisle runner further comprising an extender mount;
the extender mount being integrated with the free end; and
the extender mount being removably attached to the mobile runner extender.

5. The automated aisle runner as claimed in claim 1 comprises:
the aisle runner further comprising a plurality of lights; and
the plurality of lights being distributed along the runner body.

6. The automated aisle runner as claimed in claim 5 comprises:
the automated control unit further comprising a microcontroller;
the microcontroller being positioned within the housing; and
the microcontroller being operably connected to the plurality of lights.

7. The automated aisle runner as claimed in claim 5 comprises:
a battery pack; and
the plurality of lights being electrically connected to the battery pack.

8. The automated aisle runner as claimed in claim 7 comprises:
a battery pack; and
the battery pack being integrated with the mobile runner extender.

9. The automated aisle runner as claimed in claim 7 comprises:
a battery pack; and
the battery pack being integrated with the free end.

10. The automated aisle runner as claimed in claim 1 comprises:
a projector;
the automated control unit further comprising a microcontroller;
the microcontroller being positioned within the housing; and
the microcontroller being operably connected to the projector.

11. The automated aisle runner as claimed in claim 10, wherein the projector is integrated into the housing.

12. The automated aisle runner as claimed in claim 10, wherein the projector is wirelessly connected to the microcontroller.

13. The automated aisle runner as claimed in claim 1 comprises:
a speaker;
the automated control unit further comprising a microcontroller;
the microcontroller being positioned within the housing; and
the microcontroller being operably connected to the speaker.

14. The automated aisle runner as claimed in claim 13, wherein the speaker is integrated into the housing.

15. The automated aisle runner as claimed in claim 13, wherein the speaker is wirelessly connected to the microcontroller.

16. The automated aisle runner as claimed in claim 1 comprises:
the retraction mechanism comprising a motor and an actuator;
the runner roller being rotatably coupled to the motor; and
the actuator being operably coupled to the motor to control rotation of the runner roller.

17. The automated aisle runner as claimed in claim 1, wherein the retraction mechanism is a hand crank.

18. The automated aisle runner as claimed in claim 1 comprises:
the mobile runner extender comprising a mobile motor and a plurality of wheels; and one or more of the plurality of wheels being driven by the mobile motor.

19. The automated aisle runner as claimed in claim 1, wherein the mobile runner extender is a drone.

20. The automated aisle runner as claimed in claim 1 comprises:

a vertical deployment device; and the vertical deployment device being adjacently connected to the free end, wherein the vertical deployment device is configured to lift the aisle runner to a vertical position.

21. The automated aisle runner as claimed in claim 1 comprises:

the automated control unit further comprising a locking mechanism;

the locking mechanism being mounted within the housing; and the locking mechanism being selectively engaged with the runner roller.

* * * * *